US005328390A

United States Patent [19]

Johnston et al.

[11] Patent Number: 5,328,390

[45] Date of Patent: Jul. 12, 1994

[54] MODULAR TELECOMMUNICATION JACK ADAPTER

[75] Inventors: James J. Johnston, Newington, Conn.; Joseph Carswell, Morganton, N.C.

[73] Assignee: Hubbell Incorporated, Orange, Conn.

[21] Appl. No.: 938,711

[22] Filed: Sep. 1, 1992

[51] Int. Cl.[5] ..... H01R 25/00

[52] U.S. Cl. ..... 439/638; 439/676

[58] Field of Search ..... 439/676, 638-654

[56] References Cited

U.S. PATENT DOCUMENTS

| | | | |
|---|---|---|---|
| 4,241,974 | 12/1980 | Hardesty | 439/638 |
| 4,444,451 | 4/1984 | Myers | 439/638 |
| 4,944,698 | 7/1990 | Siemon et al. | 439/638 |
| 5,169,346 | 12/1992 | Johnston | 439/676 |
| 5,176,534 | 1/1993 | Nozick | 439/651 |

*Primary Examiner*—David L. Pirlot

*Attorney, Agent, or Firm*—McCormick, Paulding & Huber

[57] ABSTRACT

A modular telecommunication jack adapter has a front part formed by at least one standard modular telephone jack and a rear part defined by a standard modular telephone plug. The front and rear parts are connected by a coupling member which defines a rearward extension of the modular jack. A plurality of resilient unitary spring wire conductors disposed within the adapter extend between the front part and the rear part and have forward end portions which define an in-line array of moveable contacts supported in cantilever position and parallel relation within the jack. The rear end portions of the resilient wire conductors are softened by annealing to receive an in-line array of spade contacts which terminate the conductors at the rear end of the plug. One or more of the conductors may be formed with a crossover formed within the connecting member.

14 Claims, 2 Drawing Sheets

MODULAR TELECOMMUNICATION JACK ADAPTER

BACKGROUND OF THE INVENTION

This invention relates in general to electrical connectors and deals more particularly with an improved modular telecommunication jack adapter for interfacing with a standard modular telephone jack, such as an RJ-11 or RJ-45 jack, to alter the electrical output appearance of the telephone jack.

The increasing demand for improved telecommunication equipment to handle high frequency signal transmission has created the need for improved high density interconnect devices which provide clean circuit paths to reduce attenuation loss, radiated noise and cross-talk. Heretofore, jack adapters have been provided for altering the output appearance of an existing telephone jack and/or splitting or dividing the jack output. The stationary contacts at the plugging end of such an adapter may be connected to the moveable contacts within the jack end of the adapter through a PC board or by hard wiring which may necessitate several terminations in each circuit path through the adapter. The use of a PC board to alter or split circuit paths has generally resulted in an adapter having a relatively large major transverse cross-section, thereby rendering the adapter unsuitable for use with a dense array of telephone jacks, as in a modular patch panel.

Accordingly, it is the general aim of the present invention to provide an improved modular telecommunication jack adapter suitable for use in a modular patch panel or the like and wherein the number of terminations between the input and output contacts of the adapter is minimized to provide clean circuit paths.

SUMMARY OF THE INVENTION

In accordance with the present invention a modular telecommunication jack adapter is provided having an adapter body which includes a front part defining at least one forwardly open telecommunication plug receptacle and a back part defining a rearwardly projecting telecommunication plug to interface with a mating standard telephone jack. A plurality of resilient unitary spring wire contacts disposed within the adapter extend from the front part to the back part and have forward end portions which define an in-line array of moveable contacts supported in cantilever position and parallel relation to each other within the front part. The conductors have rear end portions substantially softer than the forward end portions thereof. An in-line array of stationary contacts are supported in parallel relation to each other on the back part. Each of the stationary contacts is mounted in electrical contacting engagement with an associated one of the rear end portions. A means is provided for releasably retaining the adapter in connected engagement with a mating telephone jack and includes a latch member supported on the back part for movement between latching and releasing positions relative to the mating telephone jack and resiliently biased toward its latching position.

DETAILED DESCRIPTION OF PREFERRED EMBODIMENTS

Figure 1:
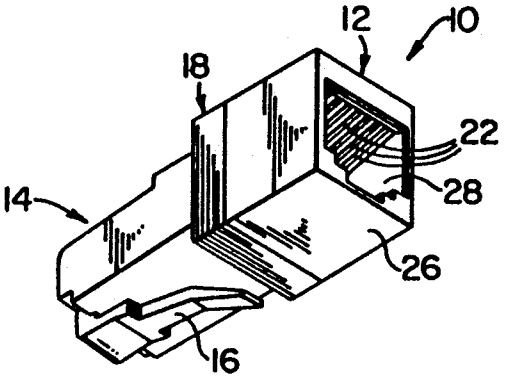
FIG. 1 is a perspective view of a modular telecommunication jack adapter embodying the present invention.
Figure 3:
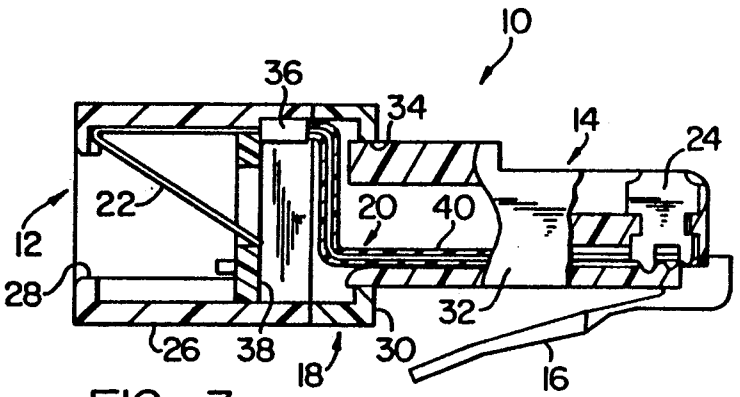
FIG. 3 is a sectional view taken along the line 3—3 of FIG. 2.
Figure 2:
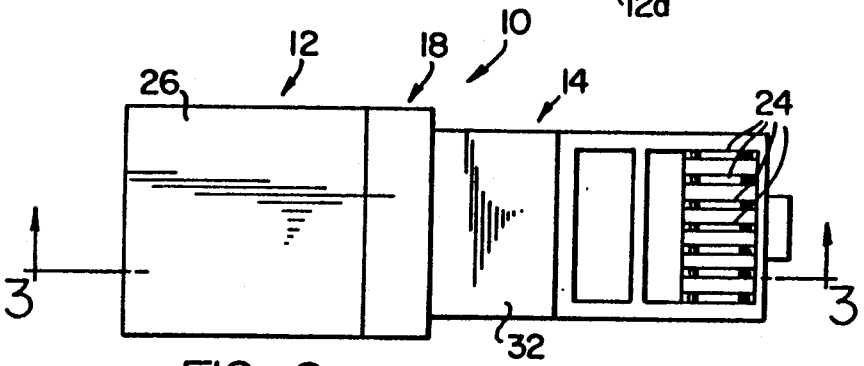
FIG. 2 is a somewhat enlarged top plan view of the jack adapter.

Turning now to the drawings and first referring to FIGS. 1–3, a modular telecommunication jack adapter embodying the present invention is indicated generally by the reference numeral 10. The illustrated jack adapter 10 is particularly adapted to be plugged into a mating standard modular telephone jack, such as an RJ 45 jack (not shown) containing an array of in-line electrical contacts terminating a plurality of electrical conductors, and to receive a standard modular telephone plug (not shown) having an in-line array of stationary contacts. The adapter 10 may be arranged to alter the number and/or sequential arrangement of the circuit paths from the mating telephone jack in which the adapter is plugged.

The illustrated modular adapter 10 is hermaphroditic and essentially comprises a front part formed by a standard modular telecommunication plug receptacle or telephone jack of RJ-45 type, indicated generally at 12, and a back part defined by a standard modular telecommunication or telephone plug, designated generally by the numeral 14. The telephone plug 14 includes a standardized integral latch member 16 for releasably retaining the adapter 10 in connected engagement with another mating telephone jack of line kind. The latch member 16 is supported on the plug 14 for movement between latching and releasing positions relative to the mating telephone jack and biased toward latching position.

The telephone jack 12 and plug 14 which comprise the jack adapter 10 may be connected together by various means. However, in accordance with the presently preferred construction, a coupling member, indicated generally at 18 and positioned between the plug and the jack, connects the plug 14 to the jack 12 substantially as shown.

Further, and in accordance with the invention, the adapter 10 includes a plurality of resilient unitary spring wire contact members conductors, indicated generally at 20, 20 which define an array of moveable contacts 22, 22 disposed within the jack 12 and which connect the moveable contacts to an array of stationary contacts 24, 24 supported by the plug 14, as will be hereinafter further described.

Considering now the adapter 10 in further detail, the modular jack 12 has a hollow generally rectangular molded dielectric plastic housing 26 having a top wall, a bottom wall, a pair of opposing sidewalls and a front wall. The frontal area of the jack 12 defines the major cross-sectional area of the front part of the adapter 10. The front wall has an opening 28 for receiving a mating standard modular telephone plug. Rearwardly facing shoulders on the rear surface of the front wall of the jack housing cooperate in latching engagement with forwardly facing shoulders on a latch member carried by the mating modular telephone plug to releasably retain the mating plug within the housing 26, in a manner well known in the telecommunication art.

The illustrated coupling member 18 comprises a generally rectangular forwardly open box shaped member preferably molded from the same dielectric material from which the housing 26 is made. The coupling member 18 forms a rearward extension of the hollow housing 26 and has a rear wall 30 and a cross-sectional configuration generally complementing the cross-sectional configuration of the rear end of the housing 26 to which the coupling member is joined by ultrasonic welding, a suitable bonding agent or other appropriate means.

The modular telephone plug 14 has a generally rectangular body 32 made from dielectric plastic material. The rectangular forward end of the body 32 is received within a complementary rectangular opening 34 formed within the rear wall 30 and is integrally joined to the coupling member 18 by ultrasonic welding or other suitable means. The latch member 16 is integrally connected by a live hinge to the lower surface of the body 32 near the rear end of the body and is resiliently biased away from the body and toward its latching position in a manner well known in the telecommunication art.

The resilient unitary spring wire conductors 20, 20 are preferably formed from 135–150 psi tensile phosphor bronze wire, gold plated over tin and extend from the front part to the back part of the adapter 10. The forward end portions of the conductors define the in-line array of moveable contacts 22, 22 supported in cantilever position within the jack 12 and spring biased to contacting positions. The contacts 22, 22 are maintained in parallel relation to each other by a contact carrier 36 and a slotted insert 38 secured within the jack 12 in a manner well known in the telecommunications art. Each conductor 20 has a rear end portion which is substantially softer than its forward end portion for a reason which will be hereinafter evident.

The stationary contacts 24, 24 are arranged in an in-line array and supported in parallel relation to each other on the plug 14. Each stationary contact 24 is mounted in electrical contacting engagement with the relatively soft rear end portion of an associated conductor 20. Preferably, and as shown, the contacts 24, 24 comprise spade contacts of the type illustrated and described in U.S. Pat. No. 4,431,246 to Vaden for Insulation Piercing Contact, issued February 14, 1984 and assigned to the assignee of the present invention. The tines on the spade contacts 24, 24 straddle, incise and resiliently grip the relatively soft rear end portions of the conductors 20, 20, substantially as shown in the Vaden patent. Each contact 24 scores an associated conductor 20 making a crimped and spring termination with fresh metal of the conductor along a rather large surface area of the contact tines thereby assuring a termination of high integrity. The sharp lower edges of the tines penetrate the plastic body 32, as shown in the Vaden patent, to securely anchor the stationary contacts 24, 24 to the plug 14. A further disclosure of the presently preferred stationary contacts and the manner in which these contacts engage and terminate the conductors 20, 20 may be had by referring to U.S. Pat. No. 4,431,246 to Vaden which is hereby adopted by reference as part of the present disclosure.

Figure 4:
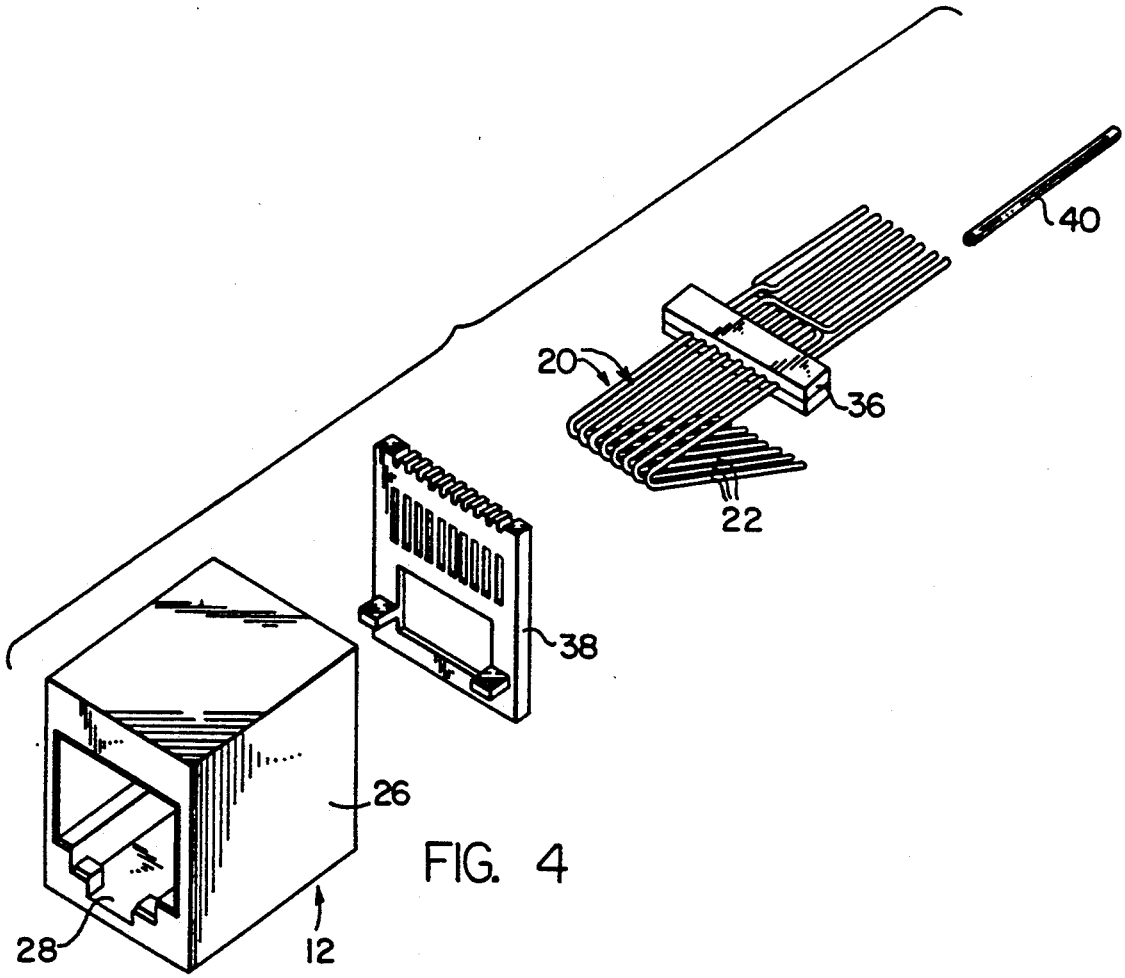
FIG. 4 is an exploded perspective view of the jack assembly.

In addition to connecting the plug 14 to the jack 12, the hollow coupling member 18 also provides space for conductor crossover whereby the circuit paths between the stationary contacts 24, 24 carried by the plug 14 and the moveable contacts 22, 22 contained within the jack 12 may be varied and for this reason the intermediate portions of the conductors 20, 20 which pass through the coupling member 18 are preferably electrically insulated. Crossover is effected by bending one or more conductors 20, 20, as necessary, to traverse one or more of the other of the conductors, as illustrated in FIG. 4, wherein a jack assembly having partially formed conductors is shown. Thus, for example, an outboard moveable contact 22 in the jack 12 may be electrically connected to an inboard stationary contact 24 carried by the plug 14 so that the adapter 10 may be used to alter the electrical appearance of a mating telephone jack into which the adapter 10 is plugged.

In accordance with a preferred method of making the adapter 10 the unitary resilient spring wire conductors 20, 20 are joined together in parallel spaced apart relation to each other by applying to the conductors a molded contact carrier assembly 36. The moveable contacts 22, 22 are preferably simultaneously formed on the conductors by bending the forward ends of the conductors rearward and downward as shown in FIG. 4 to conform with FCC specification 19528-68B. The slotted insert 38 is then applied to the formed moveable contacts after which the sub-assembly which includes the moveable contacts 20, 20, the contact carrier 36, the insert 38, and the extending end portions of the conductors 20, 20 is inserted into the rear of and assembled with the jack housing 26. The insert 36 and the contact carrier 38 are then bonded to the housing, using a compatible bonding solvent, as, for example, toluene or MEK.

The extending free rear end portion of each conductor 20 is softened by annealing to render the rear end portion, that is the end portion to which a stationary contact 26 is to be attached, substantially more ductile then the remainder of the resilient spring conductor. In accordance with the presently preferred method of practicing the invention the end portions of the conductors are simultaneously annealed by applying a flame to the end portions after the conductors have been joined tougher. Portions of the conductors exposed externally of the housing 26 are then insulated by inserting the rear end portions into and through tubular insulators 40, 40 (preferably color coded) leaving at least the annealed rear end portions exposed. The conductors 20, 20 are then bent or otherwise formed, as required, in the region between the jack housing 26 and the conductor rear end portions to form one or more crossovers, as necessary to establish desired circuit paths between the stationary contacts 24, 24 (not yet applied), and the moveable contacts 22, 22. After the required crossover or crossovers have been formed the free rear end portions of the spring wire conductors 20, 20 are trimmed to common length.

The coupling member 18 is assembled with the jack 12 and welded or bonded to the jack housing 26 to form a unitary structure. Thereafter, the modular plug 14 is assembled with and welded or bonded to the coupling member 18. The adapter assembly 10 is completed by attaching or staking the stationary contacts 22, 22 to the relatively soft rear end portions of the conductors 20, 20.

Figure 5:
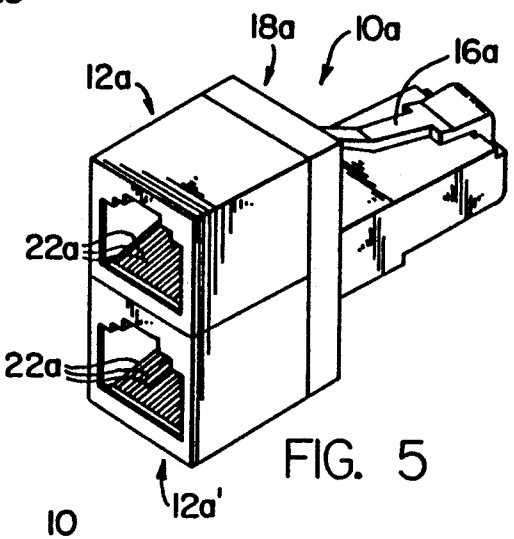
FIG. 5 is similar to FIG. 1 but shows another modular telecommuication jack adapter.
Figure 6:
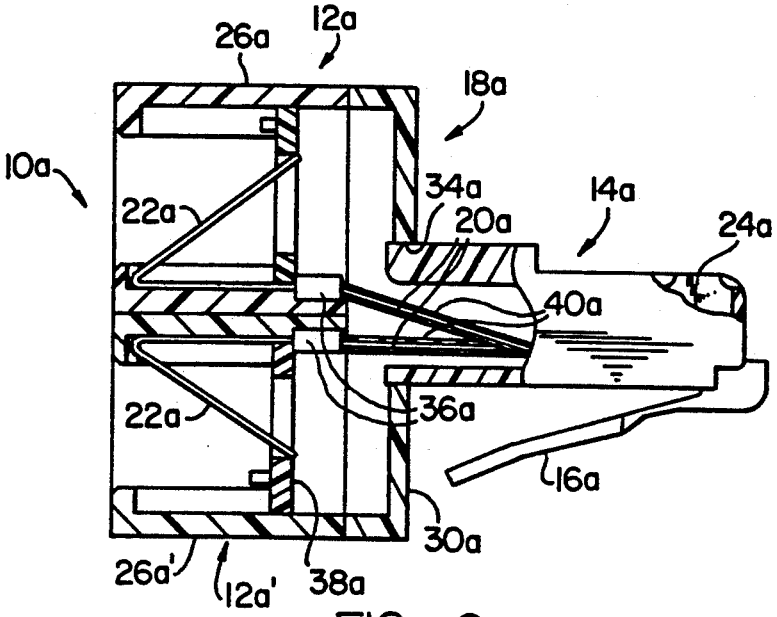
FIG. 6 is a somewhat enlarged side elevational view of the jack adapter of FIG. 5 shown partially in vertical section.

Further referring to the drawings, and considering now particularly FIGS. 5 and 6, another telecommunication jack adapter embodying the present invention is indicated generally at **10*a*. The adapter 10*a* is used to split circuit paths from an associated mating telephone jack (not shown) into which the lack adapter 10*a* is plugged and is similar in many respects to the jack adapter 10, previously described. Parts of the adapter 10***a* which generally correspond to parts of the previously described adapter 10 bear the same reference numeral and a letter "a" suffix and will not be hereinafter discussed in detail.

The illustrated jack adapter 10*a* essentially comprises a standard modular telecommunication plug 14*a* connected to a jack assembly formed by a plurality of standard telecommunication plug receptacles or jacks (two shown) joined together in vertically stacked relation to each other and which include an upper jack 12*a* and a lower jack 12*a*'. The plug 14*a* is connected to the jack assembly by a coupling member 18*a* which defines a rearward extension of the upper and lower jack housings 26*a* and 26*a*'. Like the previously described coupling member 18 the hollow coupling member 18*a* has a rear wall defining a generally rectangular central opening which receives the forward end portion of the plug 14*a*.

As previously noted, the adapter 10*a* is used to split the circuit paths terminated by a mating telephone jack into which the adapter is plugged. Consequently, some of the stationary contacts 24*a*, 24*a* carried by the telecommunication plug 14*a* are connected to moveable contacts 22*a*, 22*a* in the upper plug receptacle 12*a* while other of the spade contacts 24*a*, 24*a* are connected to moveable contacts 22*a*, 22*a* in the lower plug receptacle 12*a*'. Connection between the various contacts is provided by conductors 20*a*, 20*a*. The conductors 20*a*, 20*a* are insulated and split within the coupling member 18*a* and any crossovers which may be provided also occur generally within the coupling member.

Figure 7:
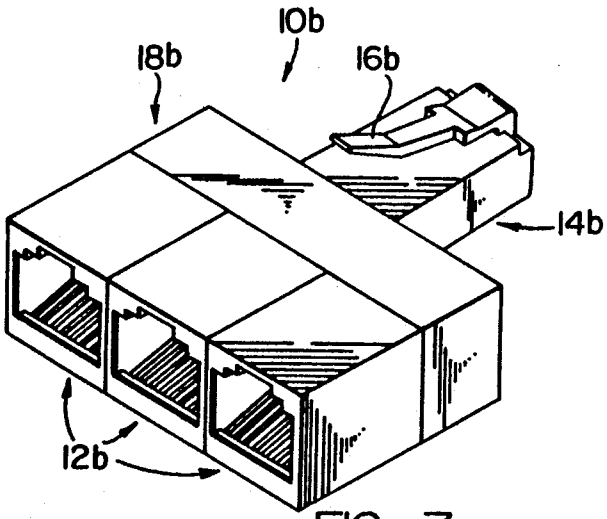
FIG. 7 is a perspective view of still another modular jack adapter embodying the present invention.

In FIG. 7 there is shown still another modular telecommunication adapter embodying the present invention and indicated generally at 10*b*. The illustrated adapter 10*b* is similar in most respects to the adapter 10*a*, previously described, but differs from it in that the jacks 12*b*, 12*b* which are connected to a single plug 14*b* are joined together in side-by-side relation to each other. The circuit paths between the stationary contacts carried by the plug 14*b* and the moveable contacts carried by the jacks 12*b*, 12*b* are split so that each jack 12*b* carries a plurality of moveable contacts which are electrically connected to associated stationary contacts within the plug 14*b*. The splits in the circuit paths and any crossovers which may be provided occur generally within the coupling member 18*b*.

We claim:

1. A modular telecommunication jack adapter comprising an adapter body having a front part defining at least one forwardly open telecommunication plug receptacle and a back part defining a rearwardly projecting telecommunication plug, an array of wire contact members disposed within said adapter, each of said wire contact members consisting of a continuous length of resilient solid spring wire extending through said adapter from said front part to said back part and having a rearwardly bent forward end portion defining a moveable contact supported in cantilever position within said front part and spring biased to a contacting position, each of said wire contact members having an annealed rear end portion substantially softer than said forward end portion thereof and supported within said telecommunications plug, an in-line array of stationary contacts supported in parallel relation to each other on said back part, each one of said stationary contacts being attached in incising engagement to an associated one of the annealed rear end portions, and means for releasably retaining said adapter in connected arrangement with a mating telephone jack and including a latch member supported on said back part for movement between latching and releasing positions and biased toward said latching position.

2. A modular telecommunication jack adapted as set forth in claim 1 wherein each of said wire contact members is insulated along a portion of its length between said forward and said rear end portions thereof.

3. A modular telecommunication jack adapter as set forth in claim 1 wherein the frontal profile of said front part defines the major cross sectional area of said front part.

4. A modular telecommunication jack adapter as set forth in claim 1 wherein at least one of said wire contact members defines a crossover.

5. A modular communication jack adapter as set forth in claim 1 wherein each of said wire contact members has an intermediate portion between said forward end portion and said rear end portion and said annealed rear end portion is substantially softer than said intermediate portion.

6. A modular telecommunication jack adapter as set forth in claim 1 wherein said front part is defined by a plurality of modular telecommunication jacks integrally joined to each other.

7. A modular telecommunication jack adapter as set forth in claim 6 wherein said modular telecommunication jacks are joined together in said-to-side engagement with each other.

8. A modular telecommunication jack adapter as set forth in claim 6 wherein at least two of said moveable contacts are disposed in each of said modular telecommunication jacks.

9. A modular telecommunication jack adapter as set forth in claim 6 wherein said modular telecommunication jacks are joined together in vertically stacked relation to each other.

10. A modular telecommunication jack adapter as set forth in claim 1 wherein said adapter body includes a coupling member integrally connected to and forming a rearward extension of said front part.

11. A modular telecommunication jack adapter as set forth in claim 10 wherein at least one of said wire contact members defines a crossover disposed within said coupling member.

12. A modular telecommunication jack adapter comprising a front part defined by at least one modular telephone jack having a hollow generally rectangular jack housing defining a telephone plug receiving opening at its forward end, a hollow generally rectangular coupling member integrally connected to the rear of said jack housing and forming a rearward extension of said jack housing, a modular telephone plug integrally connected to the rear of said coupling member and projecting rearwardly from said coupling member, said telephone plug having a latch member supported thereon for movement between latching and releasing positions and biased toward said latching position for releasably retaining said adapter in connected engagement with a mating telephone jack, a plurality of resilient unitary spring wire contact members disposed within said adapter, each of said wire contact members consisting of a continuous length of resilient solid spring wire extending from said telephone jack through said coupling member and into said telephone plug having a forward end portion defining a moveable contact supported in cantilever position within said telephone jack and spring biased to a contacting position, each of said wire contact members having an annealed rear end disposed within and proximate the rear end of said telephone plug, an in-line array of stationary contacts supported in parallel relation to each other on said telephone plug, each one of said stationary contacts being attached in incising engagement to an associated one of the annealed rear end portions.

13. A modular telecommunication jack adapter as set forth in claim 12 wherein at least one of said wire contact members defines a crossover disposed within said coupling member.

14. A modular telecommunication jack adapter comprising an adapter body having a front part defining at least one forwardly open telecommunication plug receptacle and a back part joined to said front part and defining a rearwardly projecting telecommunication plug, an array of wire contact members joined together in spaced part relation to each other and disposed within said adapter, each of said wire contact members consisting of a continuous length of resilient solid spring wire extending through said adapter from said front part to said back part and having a forward end portion formed to define a moveable contact supported in cantilever position within said front part and spring biased to a contacting position, each of said wire contact members having an annealed rear end portion substantially softer than said forward end portion thereof and supported within said back part, and an array of stationary contacts supported on said back part, each one of said stationary contacts being attached in incising engagement to an associated one of the annealed rear end portions.

* * * * *